US005310242A

United States Patent [19]

Golder

[11] Patent Number: 5,310,242

[45] Date of Patent: May 10, 1994

[54] PORTABLE INFANT SEAT

[76] Inventor: Kimberly A. Golder, 301 Edgewater Pines Dr., Warren, Ohio 44481

[21] Appl. No.: 952,322

[22] Filed: Sep. 28, 1992

[51] Int. Cl.[5] ..... A47D 1/10

[52] U.S. Cl. ..... 297/14; 297/256

[58] Field of Search ..... 297/238, 14, 113, 146, 297/254-256; 188/34, 38, 42, 47

[56] References Cited

U.S. PATENT DOCUMENTS

| | | | |
|---|---|---|---|
| 2,742,954 | 4/1956 | Boyajian | 297/256 X |
| 3,873,151 | 3/1975 | Morris et al. | 297/14 |
| 4,460,215 | 7/1984 | Chamberlain et al. | 297/14 |
| 4,664,443 | 5/1987 | Casale | 297/238 |
| 4,902,070 | 2/1990 | Casale et al. | 297/238 |

FOREIGN PATENT DOCUMENTS

| | | | |
|---|---|---|---|
| 2229107 | 12/1972 | Fed. Rep. of Germany | 108/38 |

*Primary Examiner*—Peter R. Brown
*Attorney, Agent, or Firm*—Leon Gilden

[57] ABSTRACT

An infant seat arranged for selective mounting onto a door member, as typically found within portable bathroom stalls, includes a housing arranged for mounting to the door utilizing straps or selectively a hook from the door inserted within a rear opening of the housing. A housing lid is arranged for opening to an orthogonal orientation relative to the housing floor, wherein cushions mounted within the housing and the lid and harness structure is arranged to secure an infant relative to the stall door.

5 Claims, 4 Drawing Sheets

PORTABLE INFANT SEAT

BACKGROUND OF THE INVENTION

1. Field of the Invention

The field of invention relates to infant seat structure, and more particularly pertains to a new and improved portable infant seat wherein the same is arranged to provide for a manner of positioning an infant within a lavatory environment to maintain a sanitary environment for the infant.

2. Description of the Prior Art

Infant seats of various types are utilized throughout the prior art, such as exemplified in U.S. Pat. Nos. 4,818,016; 4,948,120; and 4,844,537.

The infant seat structure of the instant invention is arranged to address deficiencies of the prior art by providing for an infant seat that may be portably manipulated and transported for positioning within a public lavatory environment to provide for a sanitary seating condition for an infant and in this respect, the present invention substantially fulfills this need.

SUMMARY OF THE INVENTION

In view of the foregoing disadvantages inherent in the known types of infant seat apparatus now present in the prior art, the present invention provides a portable infant seat wherein the same is arranged for selective mounting to a lavatory door. As such, the general purpose of the present invention, which will be described subsequently in greater detail, is to provide a new and improved portable infant seat which has all the advantages of the prior art infant seat apparatus and none of the disadvantages.

To attain this, the present invention provides an infant seat arranged for selective mounting onto a door member, as typically found within portable bathroom stalls, including a housing arranged for mounting to the door utilizing straps or selectively a hook from the door inserted within a rear opening of the housing. A housing lid is arranged for opening to an orthogonal orientation relative to the housing floor, wherein cushions mounted within the housing and the lid and harness structure is arranged to secure an infant related to the stall door.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable infant seat which has all the advantages of the prior art infant seat apparatus and none of the disadvantages.

It is another object of the present invention to provide a new and improved portable infant seat which may be easily and efficiently manufactured and marketed.

It is a further object of the present invention to provide a new and improved portable infant seat which is of a durable and reliable construction.

An even further object of the present invention is to provide a new and improved portable infant seat which is susceptible of a low cost of manufacture with regard to both materials and labor, and which accordingly is then susceptible of low prices of sale to the consuming public, thereby making such portable infant seats economically available to the buying public.

Still yet another object of the present invention is to provide a new and improved portable infant seat which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
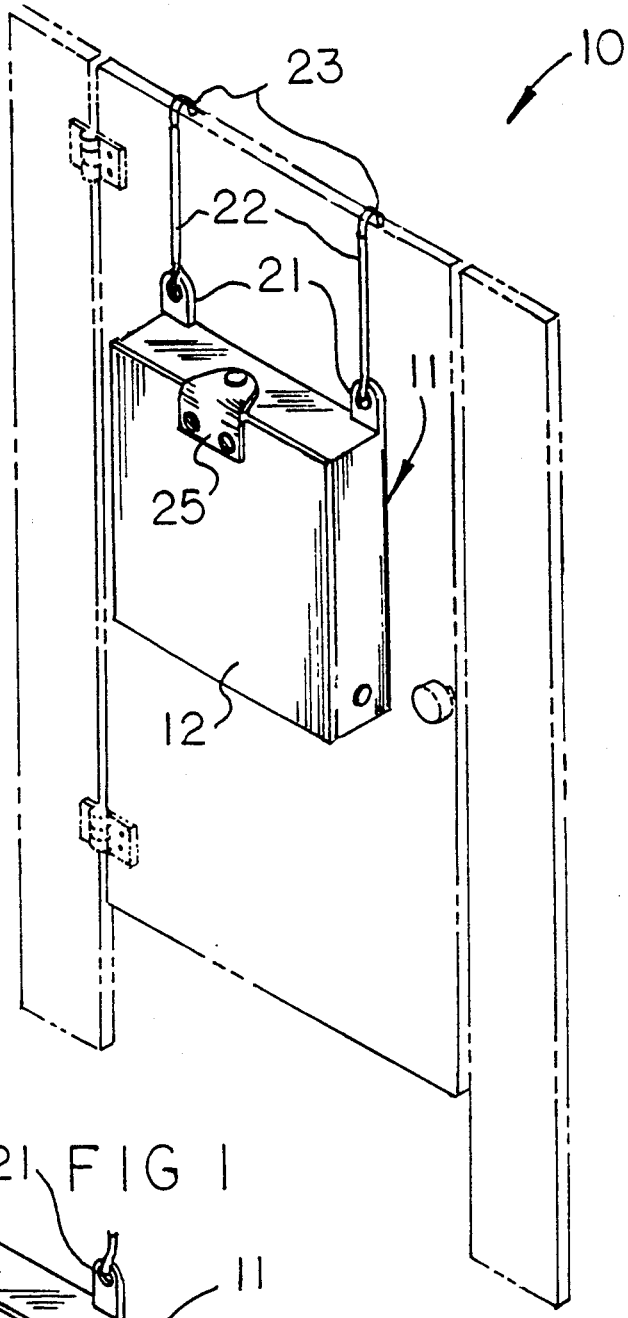
FIG. 1 is an isometric illustration of the invention mounted to a lavatory door.

With reference now to the drawings, and in particular to FIGS. 1 to 8 thereof, a new and improved portable infant seat embodying the principles and concepts of the present invention and generally designated by the reference numeral 10 will be described.

More specifically, the portable infant seat 10 of the instant invention essentially comprises selective mounting to a door, as indicated in FIG. 1, such as to be found in a public lavatory environment. Such doors are typically provided with a hook mounted to an interior surface thereof, wherein such hook is arranged for reception within a housing 11 of the invention. The housing 11 has a housing lid 12 securable to the housing. The housing having a housing rear wall, with a rear wall aperture 17 (see FIGS. 3 and 7) to receive the afore mentioned hook.

The housing 11 is formed with bottom and top walls 14 and 15 respectively mounted to the respective lower and upper edges of the rear wall 13 in a parallel relationship, with side walls 16 extending between the top and bottom walls. Within the housing cavity thusly defined within the wall structure is a housing cushion 18. A hinge pin 19 is orthogonally directed through the side walls in adjacency to and parallel the bottom wall 14 directed through bearing blocks 20 that are fixedly mounted to the bottom wall 14. The hinge pin 19 hingedly mounts the lid 12, in a manner to be described in more detail below.

The top wall 15 includes a plurality of top wall support tabs 21 having support straps 22 mounted thereto, with each free end of each strap 22 having a hook 23 for securement over the associated door structure for such lavatory doors not provided with the aforenoted hook structure for mounting the housing 11.

The lid 12 is secured to the housing top wall 15 by use of a flexible fastener web 25 securable to a fastener member 24.

Figure 2:
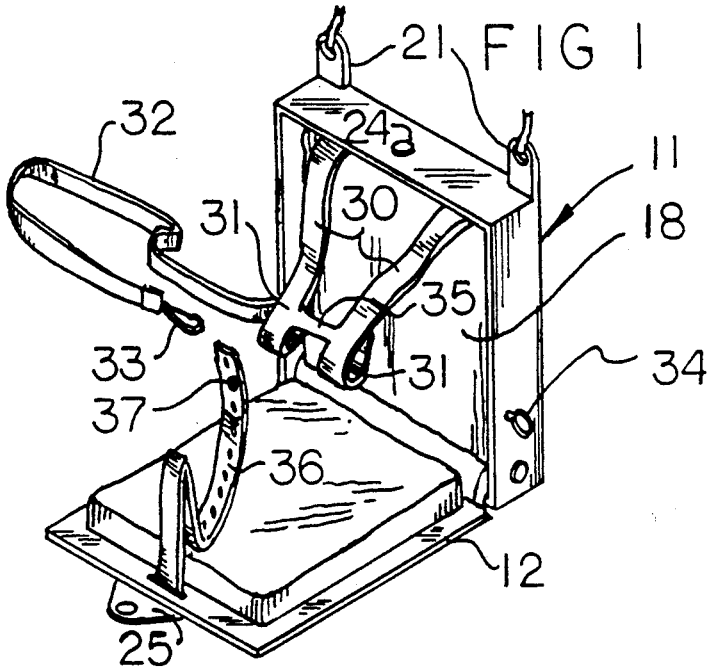
FIG. 2 is an isometric illustration of the infant seat structure in an open orientation.
Figure 3:
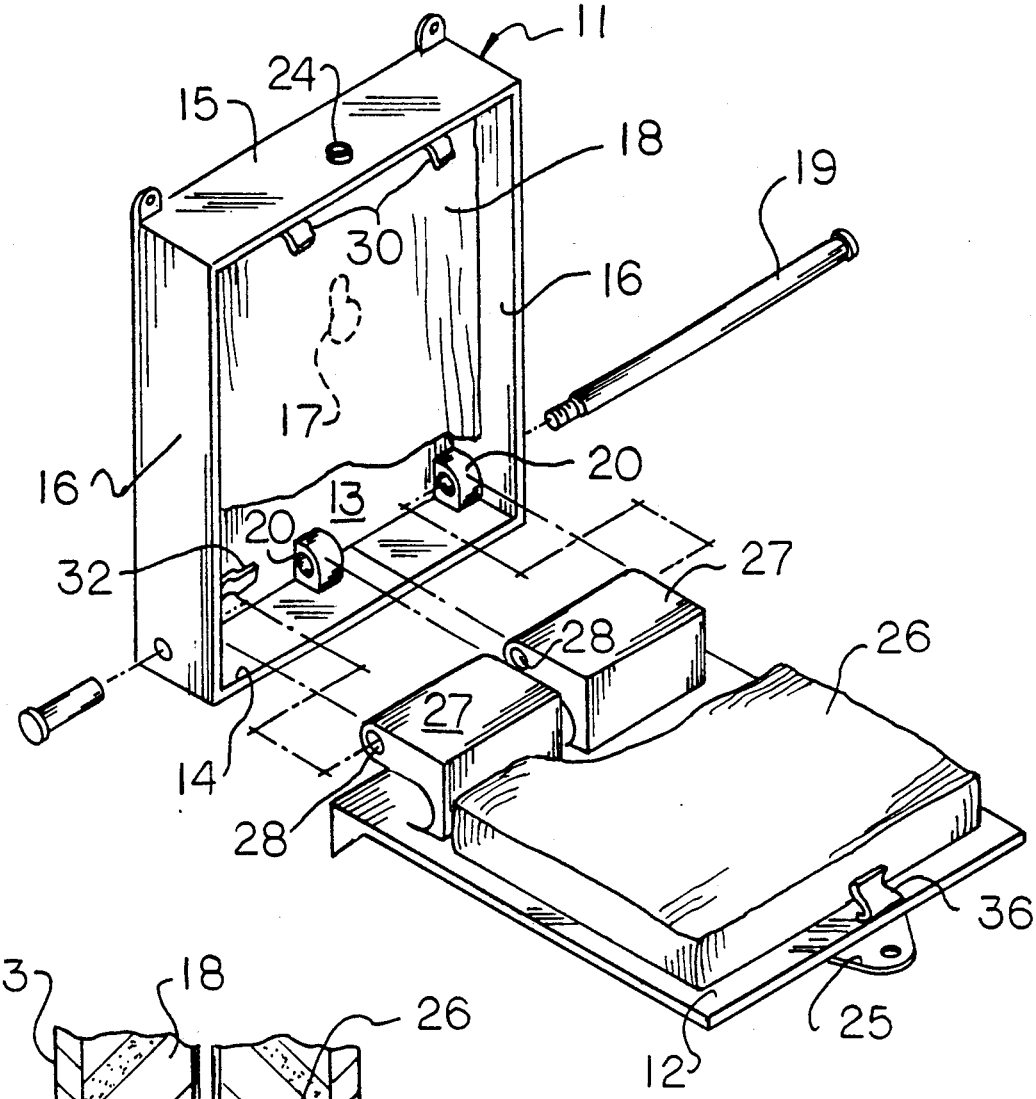
FIG. 3 is an isometric illustration of the invention indicating the hinge structure utilized by the invention.
Figure 4:
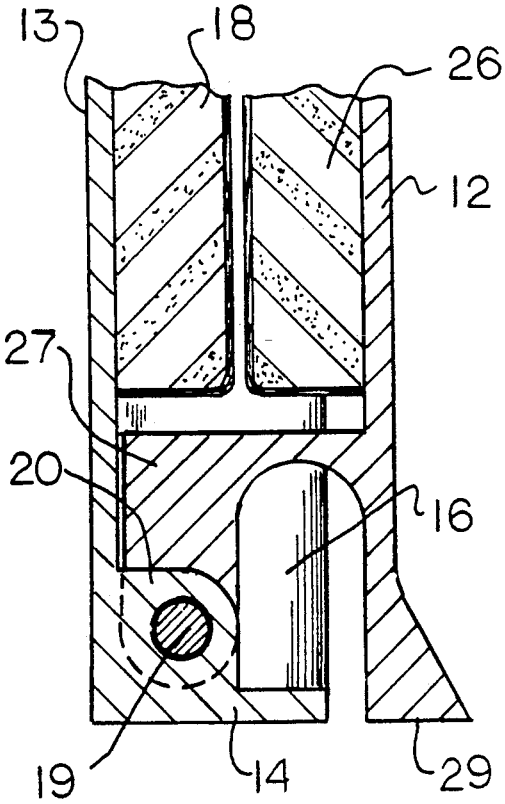
FIG. 4 is an orthographic cross-sectional illustration of the housing and lid in closed configuration.

The lid 12 is formed of a plurality of lid hinge blocks 27 that are mounted to an interior surface of the door and are provided in an L-shaped configuration to provide a spacing between the interior surface of the door as the lid hinge blocks 27 are arranged, each with a hinge block bore 28 to receive the hinge pin 19. In this manner, the bores 28 are coaxially aligned with the bearing blocks 20. The lower distal end of the lid 12 is provided with a lid flange foot 29 to effect engagement with the lavatory door when opened to an orthogonal orientation of the lid 12 relative to the housing rear wall 13, in a manner as indicated in FIGS. 2 and 3 for example.

To secure an infant within the seat structure, a plurality of torso harness straps 30 are mounted to the housing top wall 15 and extend therefrom terminating in torso loops 31, with a torso connecting web 35 securing the torso straps together in adjacency to the torso loops 31. A cross strap 32 is provided mounted to one of the side walls and arranged to extend through the loops 31 and securable to a cross strap loop 34 mounted to an opposing side wall 34 to secure an infant's torso to the housing cushion 18. A crotch strap 36 mounted to the interior surface of the lid 12 in adjacency to the flexible fastener web 35 includes a crotch strap fastener structure 37 that is arranged to loop over the torso flap connecting web 35 and thereafter fastened to itself to secure an infant within the seat structure of the organization.

Figure 5:
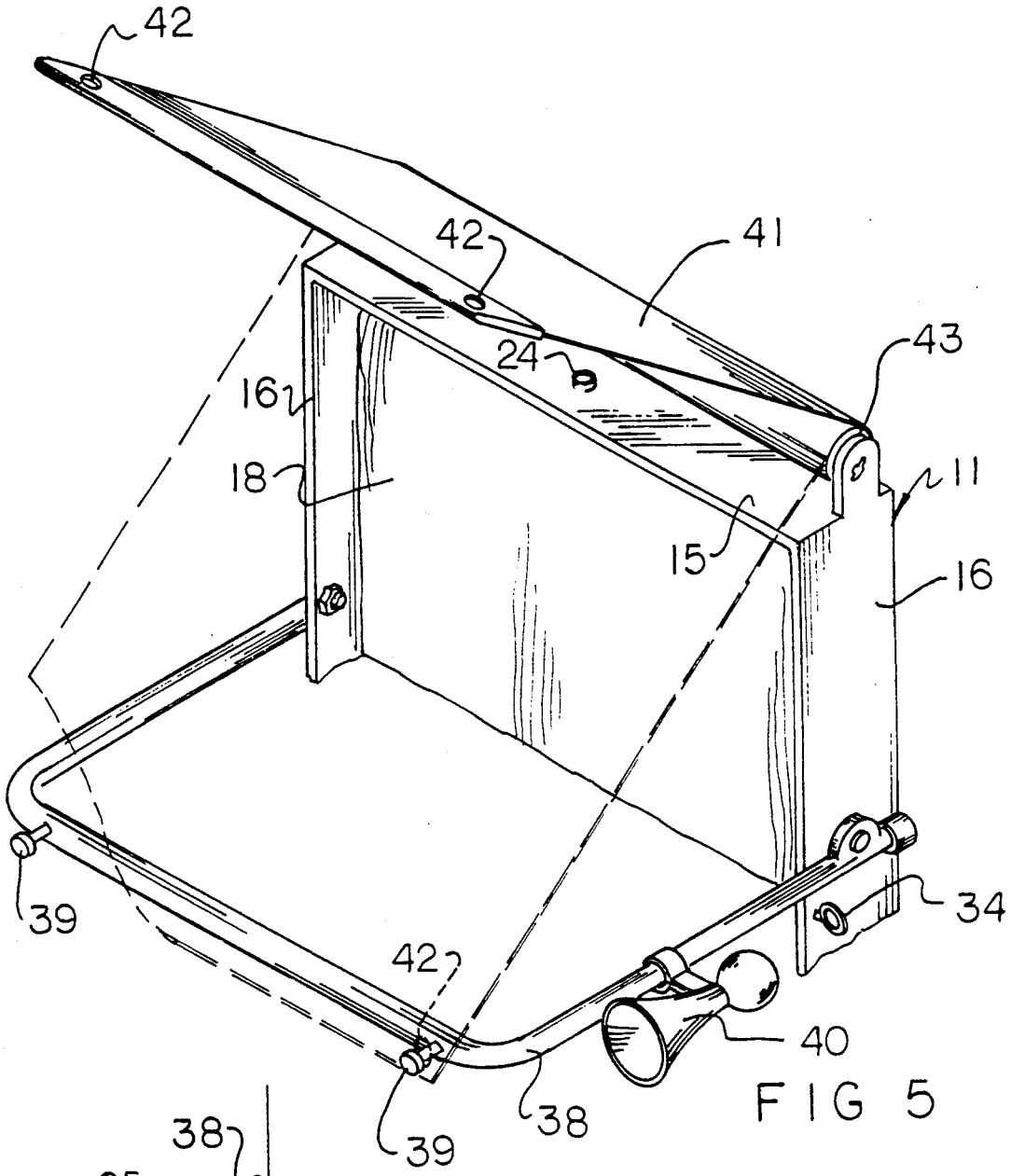
FIG. 5 is an isometric partial illustration of the invention indicating the use of a privacy shield structure.
Figure 6:
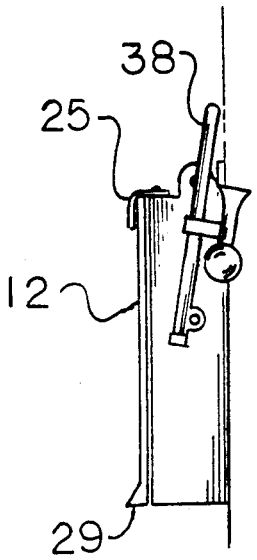
FIG. 6 is an orthographic side view of the infant seat structure in a closed configuration.
Figure 8:
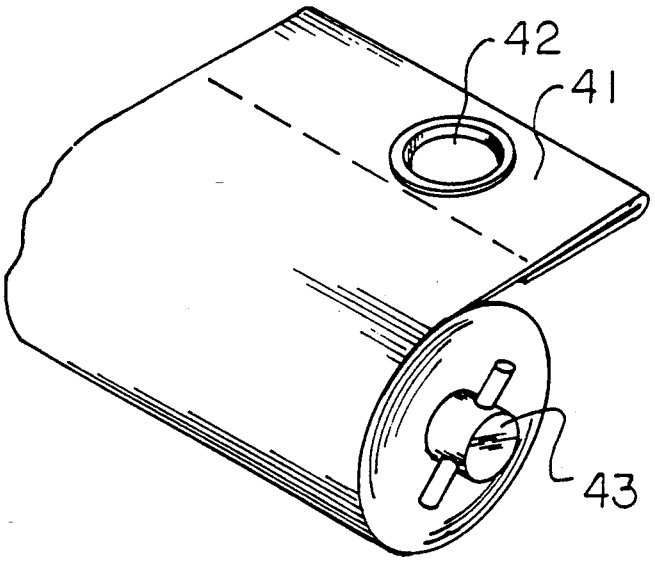
FIG. 8 is an isometric enlarged illustration of the privacy shield structure utilized by the invention.

The FIG. 5 indicates the use of a privacy shield that may be employed by the invention, wherein a U-shaped torso bar 38 pivotally mounted to the side walls 16 includes a plurality of torso bar lugs 39. The torso bar lugs 39 are arranged to receive and secure a flexible curtain 41 that is mounted to a curtain retraction spool 43 that in turn is secured to the housing top wall 15. It should be noted that the U-shaped torso bar 38 may be optionally provided with a horn member 40 for amusement of a child when supported in a manner as indicated in FIG. 1. The flexible curtain 41 having curtain apertures 42 at its free distal end is arranged to direct the curtain apertures 42 over a respective bar lug 39 to secure the curtain, in a manner as indicated in FIG. 5.

Figure 7:
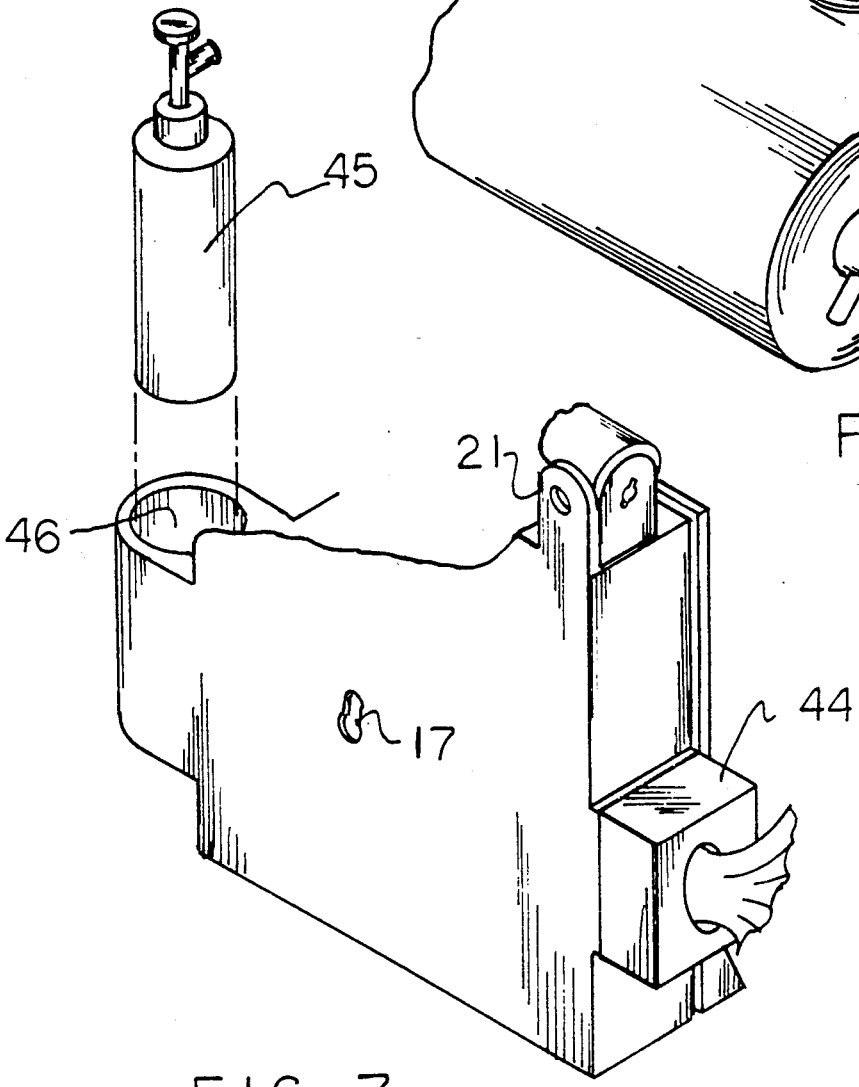
FIG. 7 is an isometric partial view of the invention to further employ a bactericide and tissue dispenser structure to maintain a sanitary environment for an associated infant.

The FIG. 7 indicates the use of the housing 11 having a tissue container 44 for dispensing tissues therefrom to one of the side walls 16, with the opposing side wall 16 provided with a dispenser support cavity 46 to receive a bactericide filled dispenser 45 for dispensing bactericide to assist in a cleaning procedure to insure a sanitary seating to an infant mounted within the seat structure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A portable infant seat arranged for securement to a door, having a housing, the housing including a housing rear wall, a housing top wall spaced from a housing bottom wall, and spaced housing side walls, with the housing rear wall having a rear wall cushion positioned within the housing, and a rear wall aperture directed through the rear wall between the side walls, and the housing further having a housing lid, and the housing including a hinge pin directed orthogonally through the side walls, and the housing lid having a plurality of hinge blocks to receive the hinge pin therethrough to hingedly mount to lid to the housing, and the housing lid having a housing fastener web, and the housing top wall including a fastener member, wherein the fastener web is selectively secured to the housing member to secure the fastener lid in adjacency to the housing in a first position and permit release of the housing lid to orthogonally orient the housing lid relative to the housing rear wall in a second position, and the housing lid includes a lid flange foot fixedly mounted to the housing lid in adjacency to the housing bottom wall, wherein the lid flange foot extends laterally beyond the lid for abutment with the door in the second position.

2. An infant seat as set forth in claim 1 wherein the housing top wall includes a plurality of top wall support tabs, and each tab includes a support strap, and each strap having a hook member for securement of each hook member about the door for suspension of the housing relative to the door.

3. An infant seat as set forth in claim 2 wherein the lid includes a lid cushion arranged for confronting relationship relative to the housing cushion in the first position, and the housing top wall including a plurality of torso harness straps mounted to the housing top wall extending therefrom, wherein each of the harness straps of said torso harness straps includes a torso loop and the torso harness straps further include a torso connecting web secured and extending between the torso harness straps, and a cross strap mounted to one of the side walls, and the cross strap having a cross strap hook, a further of said side walls having a cross strap loop for receiving the hook, with the cross straps arranged for projection through the torso loops, and a crotch strap mounted to the housing lid in adjacency to the fastener web, wherein the crotch strap includes a crotch strap fastener to permit securement of the crotch strap about the torso connecting web.

4. An infant seat as set forth in claim 3 including a U-shaped torso bar hingedly mounted to the side walls, the torso bar having a plurality of torso bar lugs, and a flexible curtain, the flexible curtain mounted about a curtain retraction spool, with the curtain retraction spool mounted to the top wall, and the flexible curtain having a plurality of curtain apertures, wherein each of the said curtain apertures is arranged for receiving one of said torso bar lugs therethrough.

5. An infant seat as set forth in claim 4 wherein one of the side walls includes a tissue container having a plurality of tissues contained therewithin, and a further of said side walls having a dispenser support cavity, and a bactericide dispenser contained removably within the support cavity.

* * * * *